United States Patent [19]

Horváth

[11] Patent Number: 4,796,516

[45] Date of Patent: Jan. 10, 1989

[54] ACTUATOR PROVIDING GUIDED LINEAR DISPLACEMENT

[75] Inventor: Gábor Horváth, Budapest, Hungary

[73] Assignee: LICENCIA Talalmanyokat Ertekesito es Innovacios, Hungary

[21] Appl. No.: 944,752

[22] Filed: Dec. 22, 1986

[51] Int. Cl.[4] ..... F15B 15/08

[52] U.S. Cl. ..... 92/165 R; 92/165 PR; 92/DIG. 1; 384/32; 384/49

[58] Field of Search ..... 92/5 R, 165 R, 165 PR, 92/DIG. 1; 384/7, 18, 32, 40, 42, 49, 57

[56] References Cited

U.S. PATENT DOCUMENTS

| | | | |
|---|---|---|---|
| 3,342,534 | 9/1967 | King | 384/49 |
| 4,334,717 | 6/1982 | Polidor | 384/49 |
| 4,593,957 | 6/1986 | Hidano | 384/49 |
| 4,669,365 | 6/1983 | Stoll | 92/165 R X |

FOREIGN PATENT DOCUMENTS

| | | | |
|---|---|---|---|
| 3438596 | 4/1986 | Fed. Rep. of Germany | 384/49 |

*Primary Examiner*—Gerald A. Michalsky
*Attorney, Agent, or Firm*—Handal & Morofsky

[57] ABSTRACT

An improved linear guiding mechanism with a standing part and a moving part which have respective uniform cross sections. A pair of spaced guiding channels is formed between these parts and respective linear ball bearings are arranged in both channels that interconnect the two parts. The channel walls are abutting the balls via steel bars extending along the channels. Preferably the standing part defines a cylinder in which a piston is moved and its shaft is connected to the moving part. The parts are made of light and soft material such as aluminum or plastic and manufactured by extrusion technique. The rather high variation of dimensions of such parts are compensated by means of biasing forces that press the channels together, and the biasing forces are sufficiently high to resist operational load. The length of the ball bearings is at least the half of the maximum stroke.

17 Claims, 6 Drawing Sheets

ACTUATOR PROVIDING GUIDED LINEAR DISPLACEMENT

FIELD OF THE INVENTION

The invention relates to an apparatus for providing a guided linear displacement preferably of the type which is built together with an actuator such as a pneumatic or hydraulic cylinder.

BACKGROUND OF THE INVENTION

Linear actuators are basic elements of various kinds of machines, mechanical devices and they are widely used also in the field of automation. A guided linear movement is required in an actuator when in spite of the number and kind of forces acting thereon only a linear displacement can take place. A large number of linear guiding mechanics is known in which a precisely tooled profiled guiding member defines a liner path along which a moving element can be displaced by direct sliding or rolling by means of a ball bearing. The guiding member should be as rigid as possible and there should be a minimum clearance between the moving part and the path in transversal direction.

For that reason the guiding elements are made generally of steel or of a similarly firm material on which the guiding path is tooled with a high degree of precision. This justifies the high price of precise linear guiding mechanisms.

Such guiding mechanisms can be driven by linear actuators e.g. by hydraulic or pneumatic cylinders. The connection between the linear guiding mechanism and the actuator should provide a certain degree of lateral play to be able to compensate any angular difference or lateral displacement that can take place between the axes of the guiding mechanism and of the actuator, respectively.

In the European laid open publication No. EP 0 134 398 of Mar. 20, 1985 a linear actuator is described in which the interior of the guiding member forms the cylinder of the actuator and there is a piston driven in the cylinder which is connected to a moving member rolling on a pair of opposing outer guiding surfaces of the guiding member by means of ball bearing. In such a combined design the mechanical length of the assembly is reduced compared to the separate implementation of the actuator including the cylinder and of the linear guiding mechanism, however, a precision guiding effect is obtained only if the guiding member that houses the cylinder is manufactured by a high degree of precision. If the guiding path and the axis of the cylinder are not precisely parallel, mechanical tensions can arise during the displacement and the design shown in that publication does not seem to have provided any means that could overcome such problems.

In the German laid open publication No. DE 35 13 214 a similarly combined actuator-cylinder design has been suggested, in which both the guiding member and the moving part have uniform cross sections along their entire lengths. It has also been suggested that these members be made of aluminum or even of a plastic material which are both light and soft. Owing to the uniformity of the cross sections and to the mechanical properties of the chosen material such members can be manufactured by cheap extrusion technique. Since the guiding surface of a linear guide should resist to wear, in this German publication the use of steel bars has been suggested which bars are abutting the profiled support surfaces of the members with uniform cross sections.

Although the use of cheap technique for the production of the main elements of the assembly could substantially reduce the costs, there have remained a number of problems connected with inherent properties of such technique. A first problem lies in that there is an inevitable dimensional variation between different extruded pieces which substantially exceeds the tolerance range acceptable for linear guides.

A second problem is connected with the mechanical loadability i.e. the resistance against mechanical effects that have force and torque components which are not parallel to the guiding path. These effects can impede smooth sliding of the moving element along the guided path or, alternatively a decreased loadability can substantially limit the field of use of such an actuator. The application of materials which are far less strong than steel seems to decrease mechanical strength compared to precisely tooled steel linear guiding mechanisms.

OBJECT OF THE INVENTION

The basic object of the invention is to provide an actuator with guided linear displacement that can combine the basic principles of the above referred German publication with the smooth performance of precisely manufactured quality actuators, in which the smooth displacement along the guided path is not influenced by other forces for torques acting between the standing and moving parts of the actuator.

SUMMARY OF THE INVENTION

According to the invention it has been recognized that the resilient flexible properties of extruded materials can be utilized to offset said problems if a pair of ball bearing is provided between the standing and moving parts guided along a linear path transversally biased with a pressing force which is higher than the highest transversal component of any operational load and which can flexibly and locally deform the elements defining the path to take any transversal tolerance. The ball bearings should be at least about as long as the half of the maximum stroke i.e. the maximum linear displacement.

If the transversal width of the guiding path without the introduction of the moving part and the ball bearing is by a predetermined distance d smaller than the transversal size of the moving part and the ball bearing, then the standing part will be deflected outwardly by the distance d when the moving part is introduced inoperational position. The resilient force of the wall material of the standing part during such a deflection can provide the required biasing force. The ball bearing touches steel bars abutting respective walls of guiding channels made in the wall of the standing and moving parts, respectively, and the bars can be cylindrical or profiled to ensure optimum rolling conditions for the balls. In longitudinal direction the bars are resilient, therefore they follow the form of the walls of the channels pressing them to the balls.

In an alternative embodiment a major part of the biasing force can be provided by discrete bolts pressing the guiding surface to the ball bearing, and the resilient deformation of the wall material is used only to compensate for the transversal tolerances.

In a preferable embodiment the standing part defines a cylinder for the actuator in which a piston is moved which is connected to the moving part by means of a connection that allows certain amount of transversal play between the interconnected parts.

The actuator made according to the invention has basic elements manufactured by extrusion technique and due to its compact design and transversally biased guiding path, a stable and smooth displacement takes place even in case of substantial transversal load. The resilient adjustability of the guiding path stands for the precisely tooled designs of conventional linear guiding mechanisms which is connected with a substantial reduction in productional costs.

BRIEF DESCRIPTION OF THE DRAWINGS

The invention will now be described in connection with preferable embodiments thereof, in which reference will be made to the accompanying drawings. In the drawing:

FIG. 2(*a*) is a detail of FIG. 2;

DESCRIPTION OF THE PREFERRED EMBODIMENTS

Figure 2A:
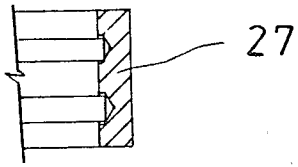
FIG. 2 shows a simplified elevational sectional view of the embodiment of FIG. 1.
Figure 1:
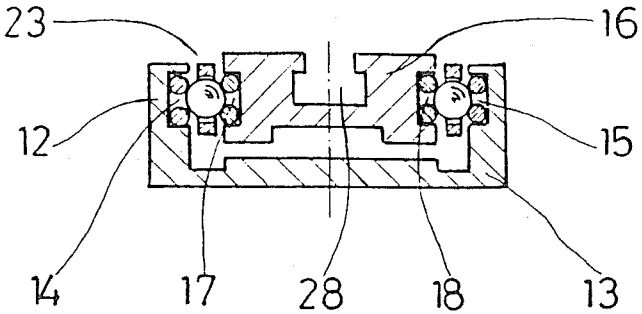
FIG. 1 shows schematically the cross section of the main elements of a first embodiment.
Figure 2:
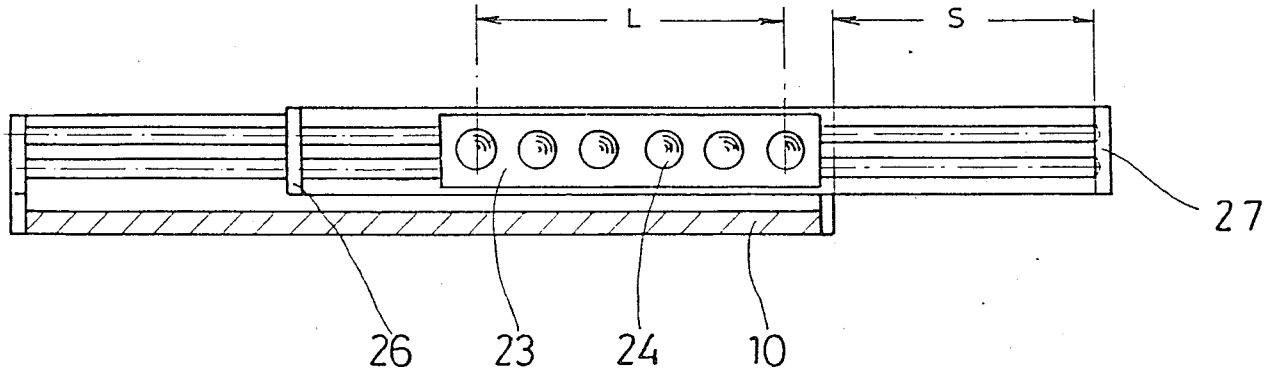
Figure 6:
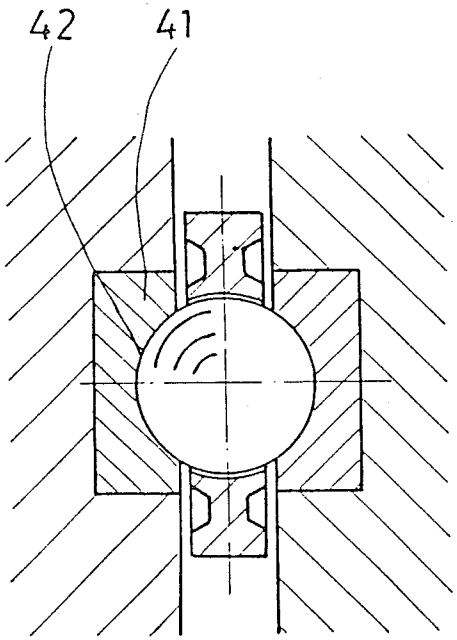
FIGS. 5 to 7 show three enlarged sectional views of three guiding channels.
Figure 7:
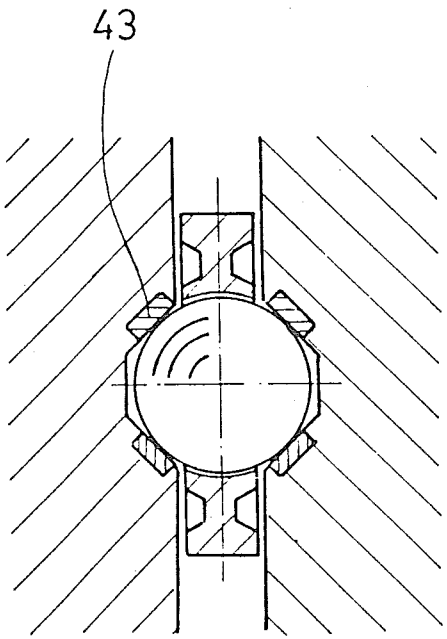
Figure 5:
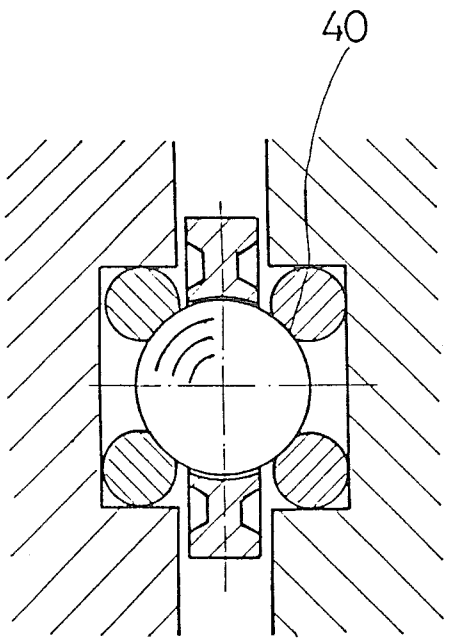
Figure 10A:
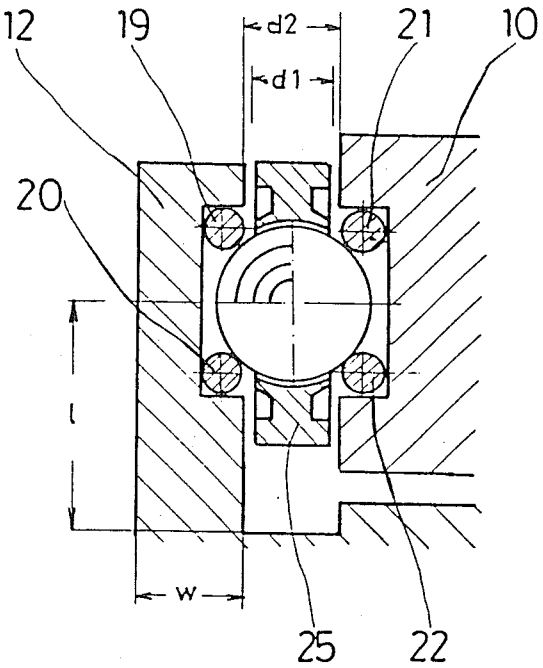
FIG. 10*a* shows an enlarged portion of FIG. 10.

The embodiment of the invention shown schematically in FIGS. 1 and 2 is capable of providing a guided linear displacement in both directions. Standing part 10 comprises a body 11 and a pair of arms 12,13 are extending out vertically from the body 11. The two arms 12,13 are spaced from each other and flat rectangular channels 14,15 are defined in internal walls thereof. Moving part 16 has a profiled cross section shown in FIG. 1 and substantially fits between the two arms 12,13 of the standing part 10. Opposite to each channel 14, 15 similar channels 17,18 are made on the outer faces of the moving part 16. Channels 14 and 17 on the left hand side and channels 15 and 18 on the right hand side define respective guiding slots, in which steel bars 19 to 22 and a ball bearing 23 are arranged. This arrangement can be seen in the enlarged view of FIG. 10*a* and alternative arrangements are shown in FIGS. 5 to 7.

Steel bars 19,20 are arranged at the two corners of the channel 14 of the standing part 10, while steel bars 21,22 are in similar corners of the channel 17 of the moving part 16. The ball bearing 23 has a length L and the balls 24 thereof are kept together by means of linear ball cage 25. Respective closing plates 26,27 are fixed to the two ends of the moving part 16 by means of bolts (not shown) that comprise holes in which the ends of the steel bars 21 to 22 are loosely fitted.

An inverse T-shaped groove 28 is extending along the moving part 16 in which connecting elements can be fitted. The standing part 10 is provided with appropriate abutting members (not shown) which limit the displacement of the moving part 16.

FIG. 2 shows the assembly in an extreme position, in which the maximum displacement i.e. stroke S has been indicated. The standing and moving parts 10,16 have respective uniform profiles along their entire lengths, therefore they can be (and preferably are) manufactured by extrusion. The material is preferably a firm aluminium alloy or the like, however, the use of extruded plastic materials can also be satisfactory for many applications.

As it has been explained hereinabove, extrusion technique cannot provide for exactly the same dimensions for each manufactured member, therefore it can well be supposed that the spacing between the channels 14,15 in case of the standing part 10 and between the channels 17,18 in case of the moving part 16 varies from member to member, and the typical tolerance range is in the order of 0.1 mm.

The problems resulting from the inaccurate dimensions of various members can be overcome by selecting a basic spacing value which is smaller than the one required during operation. In the enlarged view of FIG. 10*a* distance d1 illustrates the width of the guiding slot measurable in disassembled state. In assembled state the balls 24 stress the guiding slot to take an expanded or operational width d2. The displacement d of each arm can be expressed as $d = d2 - d1$. If the medium height of the arm 12 (up to the centre of the channel 14) is designated by l and the width of the arm 12 by w, furthermore if the material of the standing part 10 has a modulus of elasticity E, the length of the ball bearing 23 is L and the minimum transversal force by which the arm 12 should press the ball bearing 23 through the steel bars is designated by F, then the minimum required displacement d can be expressed as:

$$d = \frac{4 F l^3}{w^3 L E} \tag{1}$$

In this calculation it has been assumed that the width of the moving part 16 remains unchanged when the parts are assembled, thus the force is defined decisively by the resilient expansion of the two arms 12,13.

If in an actual embodiment the tolerance range for the spacing between the arms is not negligably small compared to the required displacement d, then the displacement can also be adjusted by selecting the standing and moving parts based on actual measurements or by using a discrete number of steel bars with gradually changing diameters and selecting the ones which ensure the required value d for the actual construction. In most applications, however, the manufacturing tolerances are small compared to realizable transversal displacements.

The force F depends on the length L of the ball bearing 23 and on the highest value of torque to which the assembly can be exposed during use. The assembled guide is exposed to the highest load in the position shown in FIG. 2. It can well be appreciated that the linear displacement of the ball bearing 23 is half compared to that of the moving part 16. In view of the properties of extrudable materials, expected loadability and convenience, it has been established that the length L should not be smaller than the half length of the maximum stroke S.

Figure 3:
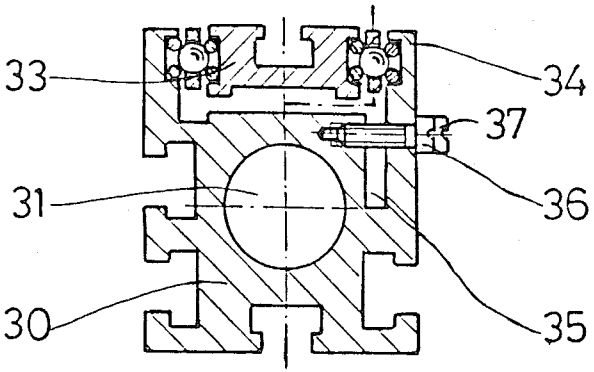
FIG. 3 is a similar view to FIG. 1 of a further embodiment.
Figure 4:
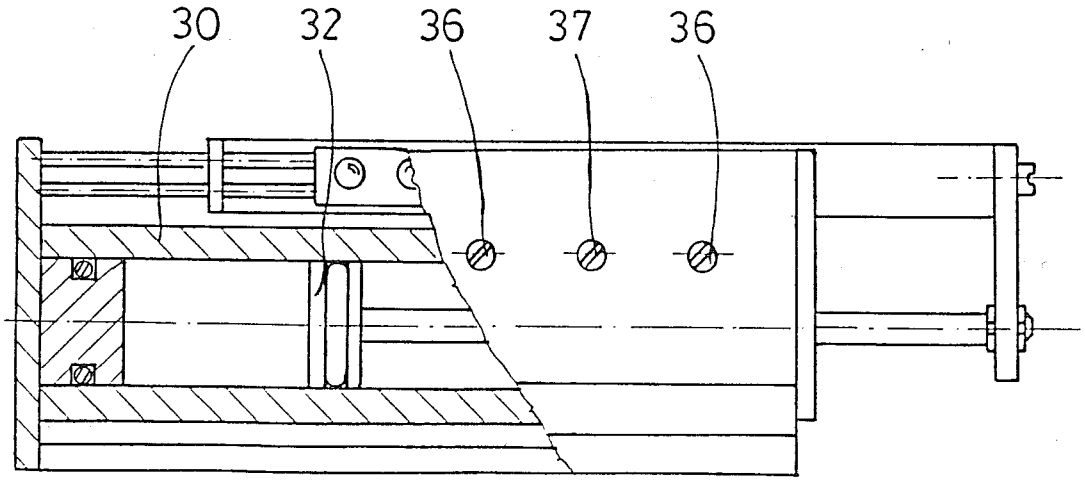
FIG. 4 shows an elevational view of the further embodiment.

The embodiment shown in FIGS. 3 and 4 differ from the previous one of two basic aspects. First, it is not only a linear guide but rather a compact linear actuator because its standing part 30 comprises a throughgoing cylinder 31 in which piston 32 can be moved by means of a pneumatic or hydraulic medium, and the piston 32 is connected to moving part 33 guided along the standing part 30 in a way similar to that shown in the previous embodiment. The second difference lies in the generation of the biasing force. FIG. 3 shows that right arm 34 is separated by the body of the standing part 30 by a deep slot 35, and due to the increased length of the arm 34 rather small transversal forces can be generated, if only the resilient deformation of the material were utilised. The upper part of the slot 35 is bridged by screw 36 engaging a threaded hole in the body of the standing part 30, whereby the arm 34 can be pulled to the ball bearing. A number of pulling screws 36 are arranged along the arm 34 and between each pairs of screws 36 a distant keeping screw 37 (FIG. 4) is arranged that cooperates with a threaded hole in the arm 34 and abuts the inner wall of the slot 35.

When the screws 36 and 37 are loose, the parts can be assembled easily. The required biasing force can be adjusted by pulling the screws 36 and adjusting the distant keeping screws 37. This way of generating the biasing force is preferable because the material can get tired following a longer use, and in that case the screws can be re-adjusted. With such an adjustment any tolerance along the length of a particular actuator can be compensated and smooth running can be adjusted. In this embodiment the biasing force can be adjusted and the adjusted value is independent from the individual variation of dimensions of the extruded components. In this way there is no need to search and select the most appropriate part before the actuator is assembled.

The form of the channels 14,15 and the profile of the steel bars 19 to 22 is significant regarding the operation. In the embodiment of FIG. 5 a cylindrical recess 40 is made by grinding on the surface of the bars that cooperate with the ball bearing. The radius of curvature corresponds to that of the balls. In this embodiment there is a longer contact line between the balls and the steel bars than in the embodiment shown in FIG. 10*a*, in which the interconnection takes place rather in a point than along a line. This embodiment can be exposed to higher load and it can offer a higher degree of precision as well. The bars are self aligning i.e. when assembled correctly they automatically take the position shown in FIG. 5.

In FIG. 6 flat rectangular bars 41 are used (one on each side) provided with a cylindrical recess 42. The advantages of this embodiment are similar to that of the previous one, this embodiment is less preferable, if larger forces can act in vertical direction.

In the embodiment shown in FIG. 7 flat steel bars 43 are used which are arranged in rectangular nests of oblique channel walls. The planes of the bars 43 make a degree of 45° with the transversal direction. Regarding the quality of support this embodiment is between about the one shown in FIG. 10*a* and that in FIG. 5. The bars of FIGS. 6 and 7 are not self aligning therefore they can be fixed in their corresponding nests.

In FIGS. 8 to 11 a detailed embodiment of the actuator according to the invention is shown. The actuator comprises standing part 50 which has a uniform profile shown in FIG. 10 defining a through cylinder. A pair of closing members 51,52 are attached to the ends of the standing part 50 by means of bolts 53 to 56. A piston 57 is guided in the cylinder for axial movement and sealing members provide sealing between the piston and the wall of the cylinder. Shaft 58 of the piston is extending out of the closing member 52.

Figure 10:
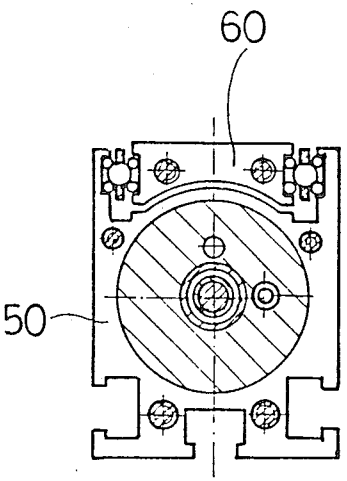
FIG. 10 is a cross sectional view taken along line X—X of FIG. 8.
Figure 9:
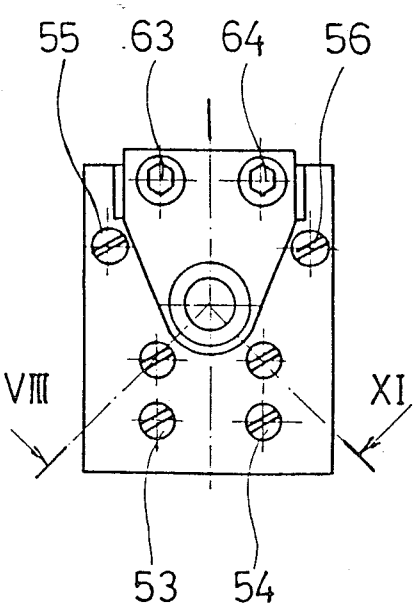
FIG. 9 is a side view of the embodiment of FIG. 8.
Figure 11:
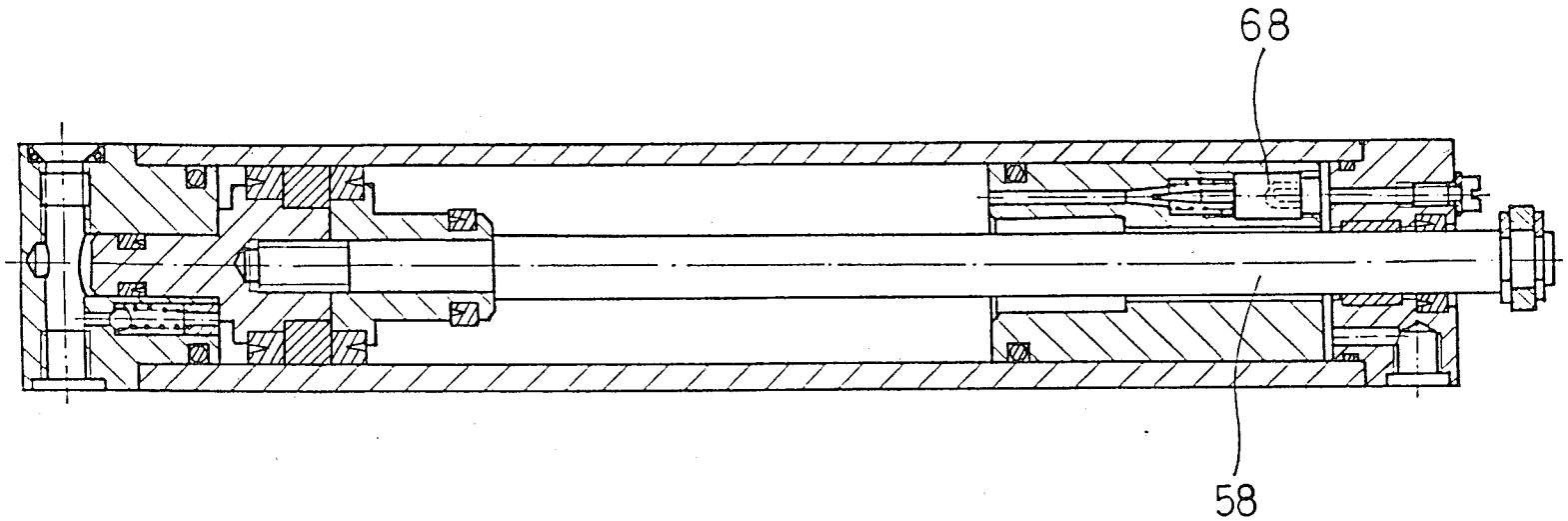
FIG. 11 is a view similar to FIG. 8, the parial section is taken along line XI of FIG. 9.

A moving part 60 is guided between arms of the standing part and its shape can be observed in FIG. 10. Respective closing plates 61,62 are fixed to the ends of the moving part 60 by means of bolts 63,64. The end of the shaft is connected through driving plate 65 to the moving part 60. The connection is provided by a pair of clamping washers 66,67 engaged in annular grooves of the shaft 58. The driving plate 65 is clamped between the washers 66,67 and it is provided by a bore slightly larger than the diameter of the shaft 58. Owing to the play between the shaft and the bore the movement of the piston can have slight lateral components compared to the guided path of the moving part.

Figure 8:
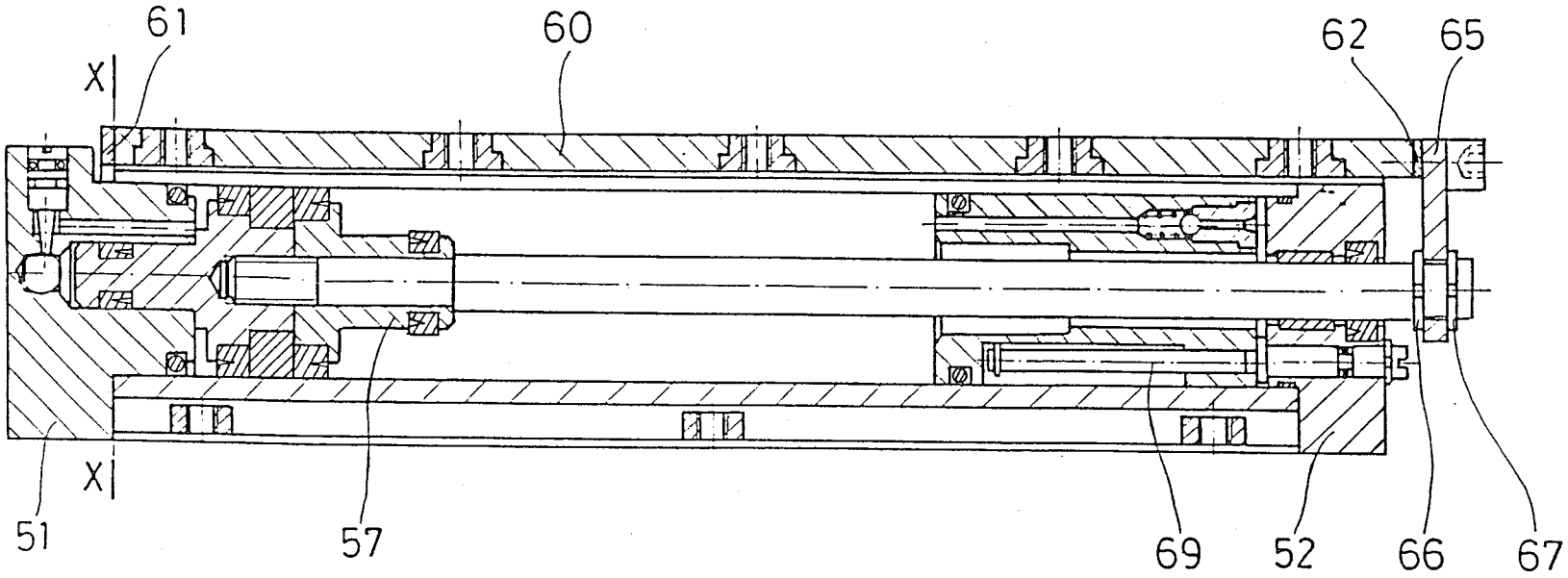
FIG. 8 is a longitudinal sectional view of a preferred embodiment, a partial section is taken along line VIII of FIG. 9.

The movement of the piston is limited at both ends by respective abutting assemblies that provide for an attenuated abutment and for the introduction of the fluid medium. The attenuation is obtained by means of respective air springs in the abutting assemblies. The required attenuation can be adjusted by screws such as screw 68 that varies the air gap in the associated air spring. FIG. 8 shows adjustment screw 69 by which the position of the right hand abutting assembly can be changed that varies the stroke of the cylinder.

The ball bearing is not shown in longitudinal section, however, its length is about 80% compared to the highest stroke.

The actuator according to the invention is compact, it is easy to manufacture, since its basic parts can be made by extrusion, and the proper adjustment of the biasing forces ensure smooth movement even if the tolerance range of the extruded parts is much higher than normally accepted values for components of linear guides.

I claim:

1. Apparatus providing a linear guided displacement with a predetermined maximum stroke, comprising an elongated stationary part and an elongated moving part each having respective uniform cross sections and comprising a resilient material less hard than steel, said parts defining a pair of spaced cooperating guiding channels extending linearly at respective side regions of said parts, one of said parts comprising a pair of spaced arms resiliently mounted on and extending out of a body portion of said one part, said channels of said one part being defined in internal walls of said arms and the other part being arranged between said arms, guiding bars in each of said channels abutting the channel wall and made of a material substantially harder than said one and said other parts, a linear ball bearing assembly in each of said channels guided between said bars and interconnecting said parts, said ball bearings being at least as long as half of said stroke, and biasing means pressing said channels towards each other to maintain sufficient fitting cooperation between said bars and said ball bearing assemblies and to provide for a smooth displacement during operation under load, said biasing means being formed by a biasing portion on said one part dimensioned and configured such that the spacing between said pair of spaced arms in a disassembled state is slightly less than when assembled, and the resilient flexing of said portion causing separation of said arms.

2. The apparatus as claimed in claim 1, in which a deep groove is defined between one of said arms and said body, and said biasing means comprising clamping means urging said arm towards said body with predetermined adjustable biasing force.

3. The apparatus as claimed in claim 2, wherein said clamping means comprise threaded pulling and abutting means arranged in an alternating sequence along said part.

4. The apparatus as claimed in claim 1, in which said standing part defining an actuator comprising a through cylinder in said part and a piston in said cylinder, said piston having a shaft coupled to said moving part.

5. The apparatus as claimed in claim 4, wherein said shaft being coupled to said moving part with a lateral play.

6. The apparatus as claimed in claim 1, wherein said bars having circular cross section.

7. The apparatus as claimed in claim 1, wherein said bars being circular and defining a longitudinal recess with a cross section forming a portion of a circular arc with a radius substantially equal to that of the balls in said ball bearing.

8. The apparatus as claimed in claim 1, in which said bars having flat rectangular cross section.

9. The apparatus as claimed in claim 8, in which said bar defining a circular groove matching to the curvature of said balls in said ball bearing.

10. The apparatus as claimed in claim 1, further comprising closing members closing the ends of said parts, said closing members defining bores for receiving respective ends of said bars, said bores being larger than said bars.

11. Apparatus providing a linear guided displacement with a predetermined maximum stroke, comprising an elongated stationary part and an elongated moving part each having respective uniform cross sections and comprising an extruded resilient material less hard than steel, said parts defining a pair of spaced cooperating guiding channels extending linearly at respective side regions of said parts, said stationary part comprising a pair of spaced arms resiliently mounted on and extending out of a body portion of said stationary part, said channels of said part being defined in internal walls of said arms and the sides of the moving part between said arms, cylindrical guiding bars in each of said channels abutting the channel wall and made of a material substantially harder than said parts, a linear ball bearing assembly in each of said channels guided between said bars and interconnecting said parts, and biasing means pressing said channels towards each other to maintain sufficient fitting cooperation between said bars and said ball bearing assemblies and to provide for a smooth displacement during operation under load, said biasing means being formed by a resilient portion of said stationary and said moving parts which is dimensioned and configured such that the spacing between said pair of spaced arms in a disassembled state is slightly less than when assembled, and the resilient flexing of said portion causes separation of said arms, and wherein a deep groove is defined between one of said arms and said body, and said biasing means further comprises clamping means urging said arm towards said body with predetermined adjustable biasing force.

12. The apparatus as claimed in claim 11, wherein said clamping means comprises threaded pulling and abutting means arranged in an alternating sequence along said part.

13. The apparatus as claimed in claim 11, in which said stationary part defines an actuator comprising a through cylinder in said part and a piston in said cylinder, said piston having a shaft coupled to said moving part.

14. The apparatus as claimed in claim 13, wherein said shaft is coupled to said moving part with a lateral play.

15. The apparatus as claimed in claim 11, wherein said bars have a circular cross section.

16. The apparatus as claimed in claim 15, wherein said bars have a longitudinal recess with a cross section forming a portion of a circular arc with a radius substantially equal to that of the balls in said ball bearing.

17. The apparatus as claimed in claim 11, further comprising closing members closing the ends of said parts, said closing members defining bores for receiving respective ends of said bars, said bores being larger than said bars.

* * * * *